US011771973B2

(12) United States Patent
Karagianis

(10) Patent No.: US 11,771,973 B2
(45) Date of Patent: Oct. 3, 2023

(54) GOLF SWING TRAINING DEVICE

(71) Applicant: Mario Karagianis, Olathe, KS (US)

(72) Inventor: Mario Karagianis, Olathe, KS (US)

( * ) Notice: Subject to any disclaimer, the term of this patent is extended or adjusted under 35 U.S.C. 154(b) by 0 days.

(21) Appl. No.: 17/860,996

(22) Filed: Jul. 8, 2022

(65) Prior Publication Data

US 2023/0021131 A1 Jan. 19, 2023

Related U.S. Application Data

(60) Provisional application No. 63/219,650, filed on Jul. 8, 2021.

(51) Int. Cl.
*A63B 69/36* (2006.01)

(52) U.S. Cl.
CPC ..... *A63B 69/3608* (2013.01); *A63B 2209/10* (2013.01)

(58) Field of Classification Search
CPC ..... A63B 69/3608; A63B 2209/10; A63B 21/0557; A63B 2225/09
USPC .... 473/206, 212, 214, 215, 422; 482/13, 44, 482/49, 74, 91, 92, 120, 121, 124, 129, 482/130, 148
See application file for complete search history.

(56) References Cited

U.S. PATENT DOCUMENTS

| | | | | |
|---|---|---|---|---|
| 2,773,691 A | | 12/1956 | Redfield | |
| 3,188,090 A | | 6/1965 | Job | |
| 3,679,214 A | | 7/1972 | Boyte | |
| 3,804,420 A | | 4/1974 | Boyd | |
| 4,895,373 A | | 1/1990 | Richmon | |
| 5,188,365 A | | 2/1993 | Picard | |
| 5,306,222 A | * | 4/1994 | Wilkinson | A63B 23/03508 482/121 |
| 5,336,151 A | * | 8/1994 | Van Ballegooie | A63B 21/0442 482/121 |
| 5,362,295 A | * | 11/1994 | Nurge | A63B 21/4013 482/121 |
| 5,397,122 A | | 3/1995 | Herridge, II | |

(Continued)

FOREIGN PATENT DOCUMENTS

| | | |
|---|---|---|
| CN | 101868282 | 10/2010 |
| JP | 2010213759 | 9/2010 |

OTHER PUBLICATIONS

Tour Striker, "Tour Striker PlaneMate" web page, Jun. 28, 2020, https://www.tourstriker.com/product/planemate/.

(Continued)

*Primary Examiner* — Nini F Legesse
(74) *Attorney, Agent, or Firm* — AVEK IP, LLC

(57) ABSTRACT

A golf swing training device having components that may be worn by a user during a golf swing. The device may include a belt portion, a stretchable connecting member, and a glove, which is worn on a user's leading hand when swinging a golf club. The glove may include a harness that wraps around a user's hand. To use the golf swing training device, a user fastens the belt around their midsection so that it is snug. One end of the connecting member may be attached to the belt at the appropriate attachment point and the other end may be attached to the glove or harness. As the user begins their backswing, the connecting member stretches and provides resistance to the hand. The stretched connecting member promotes proper club head alignment in the backswing and forward swing.

20 Claims, 10 Drawing Sheets

(56) References Cited

U.S. PATENT DOCUMENTS

| | | | | |
|---|---|---|---|---|
| 5,752,900 | A * | 5/1998 | Holland, Jr. | A63B 21/4025 482/69 |
| 5,813,955 | A * | 9/1998 | Gutkowski | A63B 21/4007 482/121 |
| 5,887,282 | A | 3/1999 | Lenhart | |
| 5,993,362 | A | 11/1999 | Ghobadi | |
| 6,027,413 | A | 2/2000 | Smith et al. | |
| 6,458,036 | B1 | 10/2002 | Gutierrez | |
| 6,755,755 | B2 | 6/2004 | Wah Loh | |
| 8,784,285 | B1 * | 7/2014 | Lopez | A63B 21/0557 482/121 |
| 2005/0107222 | A1 | 5/2005 | Toven | |
| 2005/0261113 | A1 * | 11/2005 | Wilkinson | A63B 21/4007 482/124 |
| 2007/0004571 | A1 * | 1/2007 | Gonzalez | A63B 21/4007 482/124 |
| 2010/0105531 | A1 | 4/2010 | Crawford | |
| 2010/0222189 | A1 * | 9/2010 | Washington | A63B 21/4001 482/124 |
| 2013/0333097 | A1 * | 12/2013 | Cranke | A63B 21/0557 2/300 |

OTHER PUBLICATIONS

"MYSP Golf Ultimate Golf Training Aid" video, Gary Smith, Wokefield Park in Berkshire, England, www.myspgolf.co.uk.

* cited by examiner

GOLF SWING TRAINING DEVICE

CROSS-REFERENCE TO RELATED APPLICATION

This application claims the benefit of U.S. provisional application Ser. No. 63/219,650, filed Jul. 8, 2021, titled GOLF SWING TRAINING DEVICE.

FIELD

The present invention relates to a golf training device. More specifically, it relates to a device that can be used to improve a user's golf swing.

BACKGROUND

A number of devices exist that purport to improve a person's golf game or train a person to properly hit a golf ball. The devices range from relatively large structures that surround a golfer to small items such as golf ball or tee replacements. Large structures are cumbersome and expensive and typically have to be left in one place. This means that a golfer cannot regularly use a large training device if the golfer tends to practice at multiple locations. Conversely, small training devices, while portable, tend to have only a marginal effect in improving a golfer's game. Specialized tees or golf ball replacements are typically nothing more than visual aids that do not physically align a golfer's body during a swing. What is needed is a golf training device that is convenient and portable, and also improves the user's golf swing. The present invention addresses this need.

SUMMARY

The present invention comprises a golf swing training device with various components that may be worn by a user during a golf swing. In one embodiment, the device comprises a belt portion, a glove, and a connecting member.

The glove may have a front portion and a back portion with the front portion adapted to be adjacent the palm of the user's hand and the back side adapted to be adjacent the back of the user's hand. The glove may include a looped strap or harness, which wraps around a user's hand such that a first part of the harness is adjacent the user's palm (e.g., between the user's palm and the front portion of the glove) and a second part of the harness is adjacent the back side of the user's hand. The first part of the harness can be located inside the glove and the second part of the harness outside the glove. The harness may include one or more ring members for attachment to the connecting member.

The belt may have a plurality of looped connection points (also referred to herein as annular connection points), which could take the form of ring members (such as D-rings). The connecting member may take the form of a stretchable or elastic band or tube (e.g., a rubber tube) or a variety of other things that can be stretched and will then return to their original shape. One end of the connecting member may be connected to the harness on the user's hand and the other end of the connecting member may be connected to one of the connection points on the belt. In short, one end of the connecting member secures to the belt and the other end secures to the harness or glove on the user's hand. The glove and harness are typically worn on a user's leading hand when swinging a golf club. These components create an advanced muscle memory resistance trainer that encourages your hips, arms, wrist, and hands to be in a desirable position while striking the golf ball, which leads to increased accuracy, power, and rotation throughout the golf swing.

The belt may take the form of a band of material adapted to be worn around a user's midsection. The surface of the belt that contacts a user may include a texture or series of protrusions adapted to minimize slippage of the belt on the user. The belt may include a hook and loop fastening system for securing the belt around a user. For example, the belt may have two ends with a section of hook material at one end and a section of loop material at the other end. The two ends can be fastened to secure the belt around the user. The circumference of the fastened belt may be adjusted by varying the amount of overlap of the ends where the hook and loop sections are fastened together. This adjustability allows a single belt to accommodate individuals of varying sizes. The connecting member may attach to the belt proximate the back and/or leading hip area of the user. The plurality of connection points may be located proximate a midpoint between the first and second ends of the belt, which would place the connection points proximate the back of the user. The connection points may be arranged linearly along the belt so that the reach of the connecting member may be lengthened or shortened by selecting different a different connection point without having to physically alter the length of the member. This allows the same length connecting member to be used with people having various heights and arm lengths. The connecting member may be connected to the harness around the user's hand, as well as the connection points on the belt, using a latching mechanism at each end of the connecting member to latch the respective ends to the harness and connection points. There may be a cover to conceal the connection points on the belt.

To use the golf swing training device, a user fastens the belt around their midsection so that it is snug. One end of the connecting member attaches to the belt at the appropriate attachment point and the other end of the connecting member attaches to the user's leading hand, typically by connecting to the harness or glove. As the user begins their backswing, the connecting member stretches and provides resistance to the hand. The stretched connecting member promotes proper form in the backswing and forward swing. The pulling force from the member encourages the user's hands to remain close to the body and tends to keep the club head from unintentionally being out of alignment when it strikes the ball.

An embodiment of the present invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of what has been invented by the inventor.

BRIEF DESCRIPTION OF THE DRAWINGS

FIG. 15 is a front perspective view of the golf swing training device of FIG. 8 being worn during a golf swing follow through.

DETAILED DESCRIPTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," "leftwardly," "upper," and "lower" will refer to the installed position of the item to which the reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Figure 1:
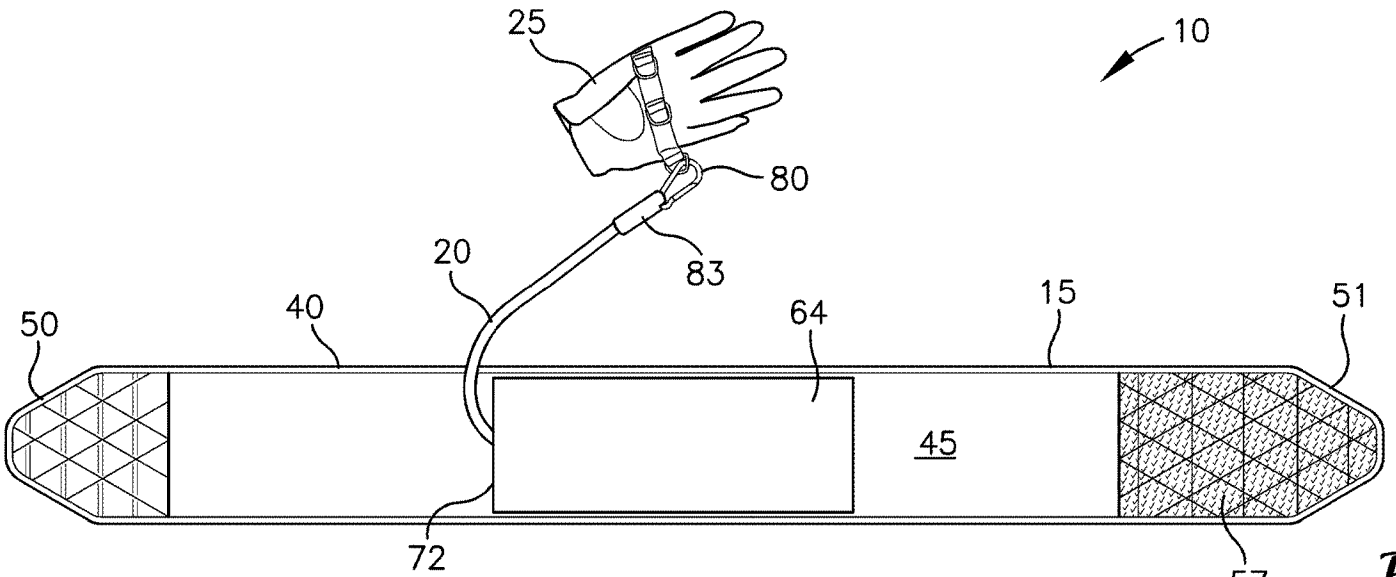
FIG. 1 is a front view of a golf swing training device in accordance with one embodiment of the present invention.
Figure 2:
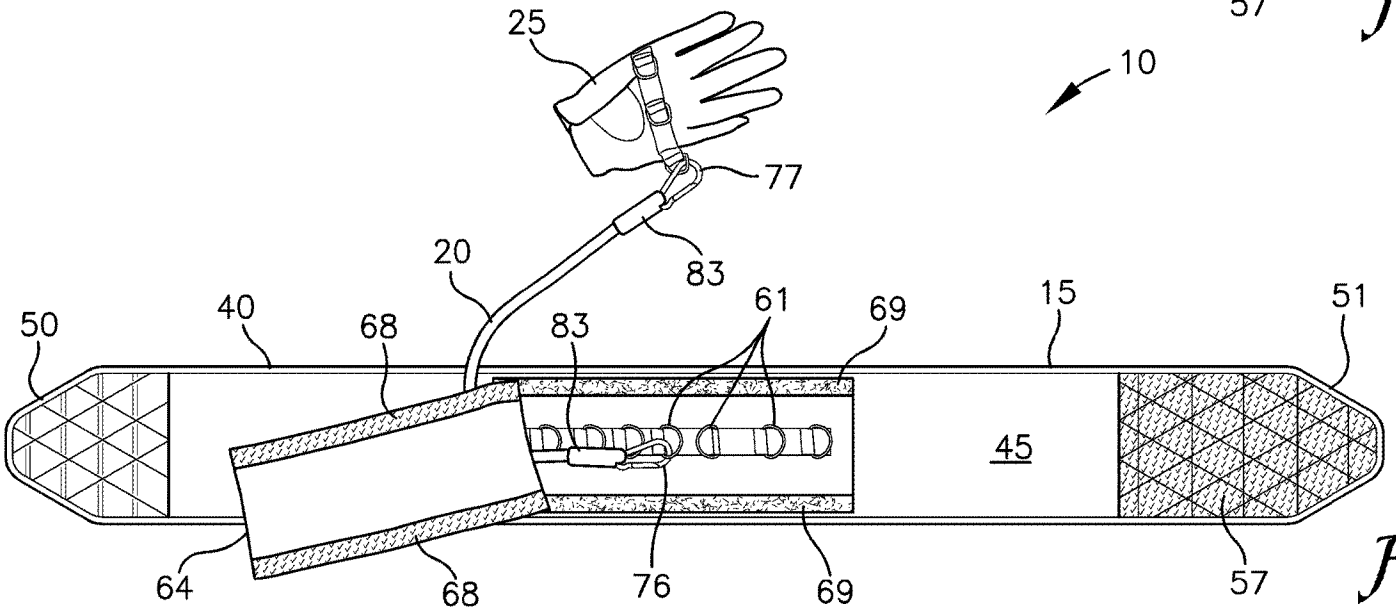
FIG. 2 is a front view of the golf swing training device of FIG. 1 with the adjustment ring cover pulled back.
Figure 3:
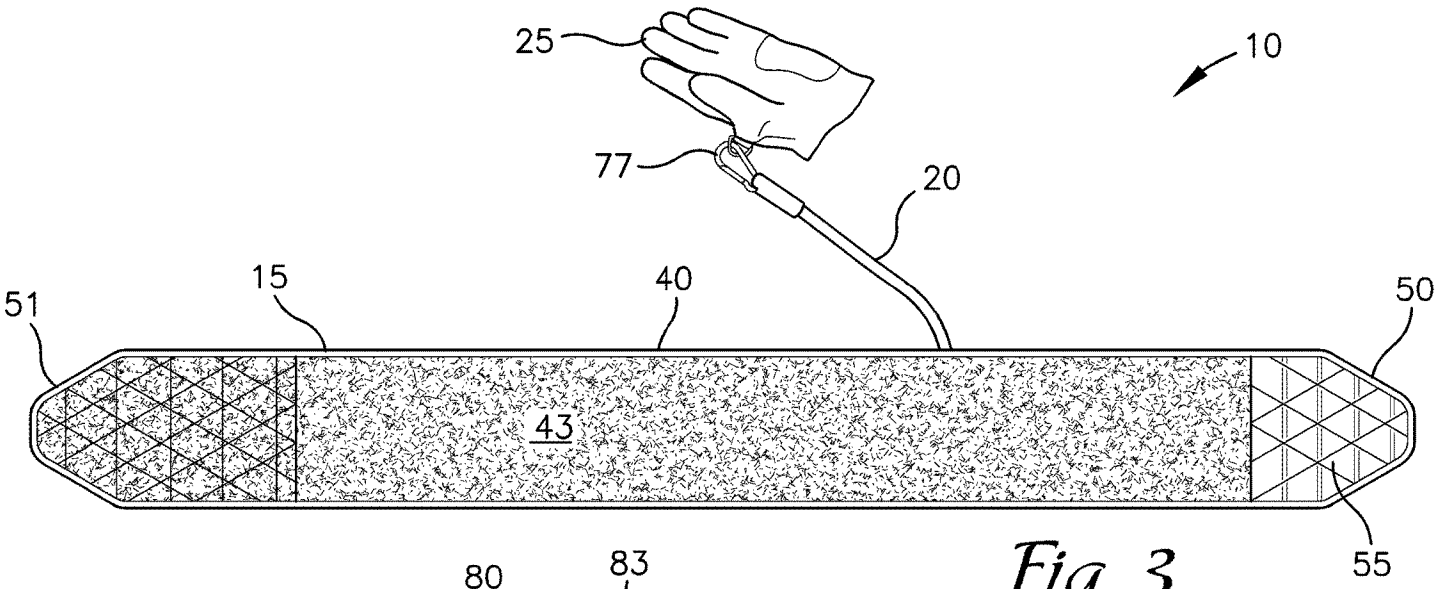
FIG. 3 is a back view of the golf swing training device of FIG. 1.

Referring to the figures, FIGS. 1-3 show an exemplary embodiment of the invention comprising a golf swing training device 10, which may include a belt portion 15, a connecting member 20, and a glove 25. One end of connecting member 20 may be secured to belt 15 and the other end secured to glove 25 (or a harness integrated into the glove as described below). In use, belt 15 and glove 25 may be worn by a user 30 while swinging a golf club 35 to help train the user to improve the user's golf swing.

As best seen in FIGS. 1-3, belt 15 may include an elongated band or panel 40 of material that can be wrapped around the midsection of a user 30. Panel 40 may be constructed of various pliable materials such as fabric, leather, plastic, rubber or the like. Belt 15 may be described as having an inner surface 43, which is the inward facing surface of panel 40 with respect to a user 30 when belt 15 is worn, and an outer surface 45, which is the outward facing surface of panel 40 with respect to a user 30 when belt 15 is worn. As shown in FIG. 3, inner surface 43 may include a texture or series of protrusions to help grip against a user 30 to minimize slippage of the belt on the user.

Belt 15 also has a first end 50, which is one end of panel 40, and a second end 51, which is the opposite end of panel 40. First and second ends 50 and 51 may be joined together to secure belt 15 around user 30. Any number of fasteners may be used to joint first and second ends 50 and 51. In the embodiment shown in the figures, belt 15 utilizes a hook and loop fastening system. A section of hook material 55 (for the hook and loop fastening system) may be located on the panel 40 at first end 50, and a corresponding section of loop material 57 may be located on panel 40 at the second end 51. The section of hook material 55 may be on the inner surface 43 proximate first end 50 and the section of loop material 57 may be on the outer surface of 45 proximate second end 51. This configuration may also be reversed such that the hook material 55 is on the outer surface 45 and the loop material 57 is on the inner surface 43. This arrangement allows the hook and loop material to be engaged by laying the first end 50 over the second end 51 (such that the inner surface 43 proximate first end 50 overlays the outer surface of 45 proximate second end 51) and pressing the hook and loop sections together, which can fasten belt 15 around a user 30. The hook and loop sections 55 and 57 may be oversized and extend along the panel 40 for some distance from their respective panel ends such that they can be engaged without the hook and loop sections 55 and 57 being in perfect alignment. In other words, hook and loop sections 55 and 57 may be sized and shaped such only a portion of each would need to engage with the other to fasten belt 15. For example, hook section 55 may substantially overlap loop section 57 when the belt is worn by one person, but the sections may barely overlap when the belt is worn by a different, larger person because the belt may not wrap as far around the larger person. By allowing the hook and loop sections 55 and 57 to engage when they are in different positions with respect to each other, belt 15 can be fastened around people of different sizes. Accordingly, it is foreseen that belt 15 can be used by different size users 30 without the need for different size belts. In other words, belt 15 may be an adjustable size that can accommodate different body sizes.

As shown in FIGS. 1 and 2, belt 15 may include a series of adjustable connection points in the form of loops or rings 61 to allow length and tension adjustment for connecting member 20 (which will be discussed in more detail below). Adjustment rings 61 may be centrally located on panel 40 on outer surface 45. A plurality of adjustment rings 61 may be aligned proximate one another in a linear fashion such that connecting member 20 can be adjusted incrementally by moving the connector to different rings 61 if desired. Additionally, having a plurality of rings 61 allows the connecting member 20 to be adjusted to fit a specific user, which further allows belt 15 to be used by different size users 30. Adjustment rings 61 may be located in any number of places on belt 15, however centrally located on the outer surface 45 is believed to be suitable for most applications. Such a location puts the adjustment rings 61 behind a user 30 when belt 15 is worn, which allows for proper orientation of connecting member 20 and also ensures that rings 61 do not interfere with the user's golf swing.

Belt 15 may also include a cover 64 for the adjustment rings 61 to prevent the rings 61 from snagging on something when belt 15 is worn or stowed and also helps protect the rings 61 from dirt and moisture. Cover 64 also may also improve the appearance of the golf swing training device 10 by providing a cleaner, more refined look and offering a location for indicia (such as branding or slogans). As best seen in FIG. 2, cover 64 may be removable or partially removable from panel 40. Cover 64 may be removably fastened to the outer surface 45 using any number of fasteners. In the exemplary embodiment, cover 64 is removably attached to outer surface 45 using hook and/or loop strips 68 running along the sides of the cover 64 and corresponding hook and/or loop strips 69 running above and below adjustment rings 61. An end 72 of cover 64 may be attached to panel 40 such that the cover can be pulled back to reveal adjustment rings 61 but the end of the cover stays attached to panel 40. This keeps the cover 64 from falling completely off belt 15 while the belt is being worn and the cover 64 is retracted. This ensures that cover 64 will not get lost when rings 61 are uncovered. Also, by remaining at least partially attached to panel 40, cover 64 may be quickly and easily fastened over rings 61 since the attached end of the cover helps keep cover 64 somewhat aligned with hook and/or loop strips 69.

Golf swing training device 10 further comprises a connecting member 20 (also referred to herein as simply a connector), which may be secured at a first end 76 to belt 15 and at a second end 77 to glove 25 (or a harness integrated into the glove as described below). Connecting member 20 may include a cord or band member that may be constructed of a stretchable material such as rubber. The member 20 may be a unitary stretchable cord (such as rubber tubing or a rubber band) or it may consist of multiple components combined to form a cord (such as braided elastic strands like a bungee cord). It is also foreseen that connecting member 20 could utilize a spring to create tension. For example, connecting member 20 could be constructed of a sheathed spring or it could be non-elastic member that is retractable into a spring-loaded housing.

At each end (first and second ends 76 and 77) of connecting member 20 there may be a fastener such as a clip 80 for securing the connector to either belt 15 or glove 25 (or the integrated harness). Clip 80 may be a springing gate shackle or carabiner style clip or any other type of clip that will keep connecting member 20 securely attached to belt 15 or glove 25 when in use. As shown in FIG. 2, each clip 80 may be attached to connecting member 20 by feeding an end of connecting member 20 through clip 80 and folding the connector back on itself. A sleeve 83 may be placed around the folded end of the connecting member 20, using pressure and friction to keep the end folded, thereby keeping clip 80 secured on the end of the connecting member 20. It is foreseen that clip 80 could be secured to connecting member 20 in any number of other ways including adhesive, chemical welding, or mechanical fastening. Connecting member 20 may come in various lengths depending on the application and material used. In one embodiment, lengths of sixteen and twenty-one inches (including the lengths of the clips 80) are suitable. Also, training device 10 may include interchangeable connecting members 20 that selectively increase the resistance provided by the member during a backswing. For example, a plurality of connecting members 20 offering multiple levels of resistance (e.g., ten, twenty, thirty and forty pounds of resistance) may be included with a training device 10 to allow the user 30 to progressively increase the resistance level thereby increasing strength and club head speed over time.

As best seen in FIG. 2, clip 80 at the first end 76 of connecting member 20 may be secured to an adjustment ring 61. Connecting member 20 may be routed under cover 64 such that the clip 80 can attach to a ring 61 while cover 64 is in place. In an exemplary embodiment, a portion of end 72 of cover 64 may not be attached to panel, thereby allowing connecting member 20 to access adjustment rings 61 while being routed underneath cover 64.

As shown in the figures, golf swing training device 10 may include a glove 25, which is worn on the leading hand of user 30. As best seen in FIGS. 4-7, glove 25 may have a closure mechanism such as flap 87 in combination with a slit 90. Slit 90 can be located on the back of the glove 25 and extend from the wrist to the knuckle portion of the glove 25. The slit 90 allows glove 25 to be opened or enlarged by pulling slit 90 apart to allow the glove 25 to be put on or removed from a hand. Flap 87 may be located adjacent slit 90 such that it spans from one side of the slit to the other. Flap 87 may include a fastener such as a hook and loop material, which allows flap 87 to be secured to a surface of glove 25 that is on the opposite side of the slit 90 from flap 87. This arrangement allows flap 87 to be fastened with slit 90 in the desired configuration. For example, flap 87 may be fastened with slit 90 in either a spread apart or closed configuration depending on what is comfortable for the user 30. As shown in FIG. 7, flap 87 may be unfastened and slit 90 spread apart prior to placing glove 25 on a hand to allow space for the hand. Flap 87 may then be re-fastened when the glove 25 is in place. Flap 87 should be fastened such that glove 25 feels snug on the user's hand. It is foreseen that glove 25 could be something similar to a traditional golf glove which completely covers a hand, or it could be a wearable that only partially covers the hand.

Figure 4:
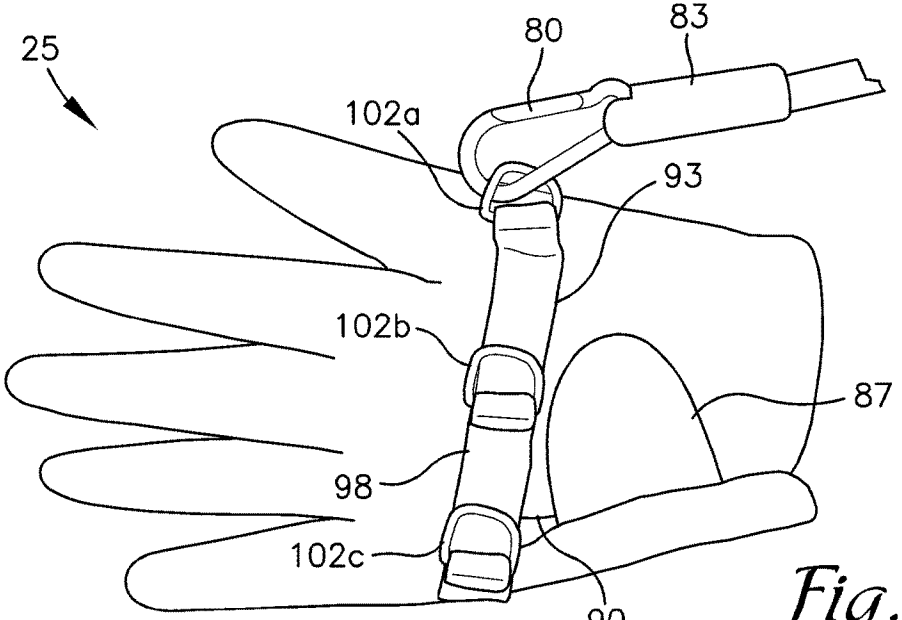
FIG. 4 is an enlarged front view of the glove portion of the golf swing training device of FIG. 1.
Figure 5:
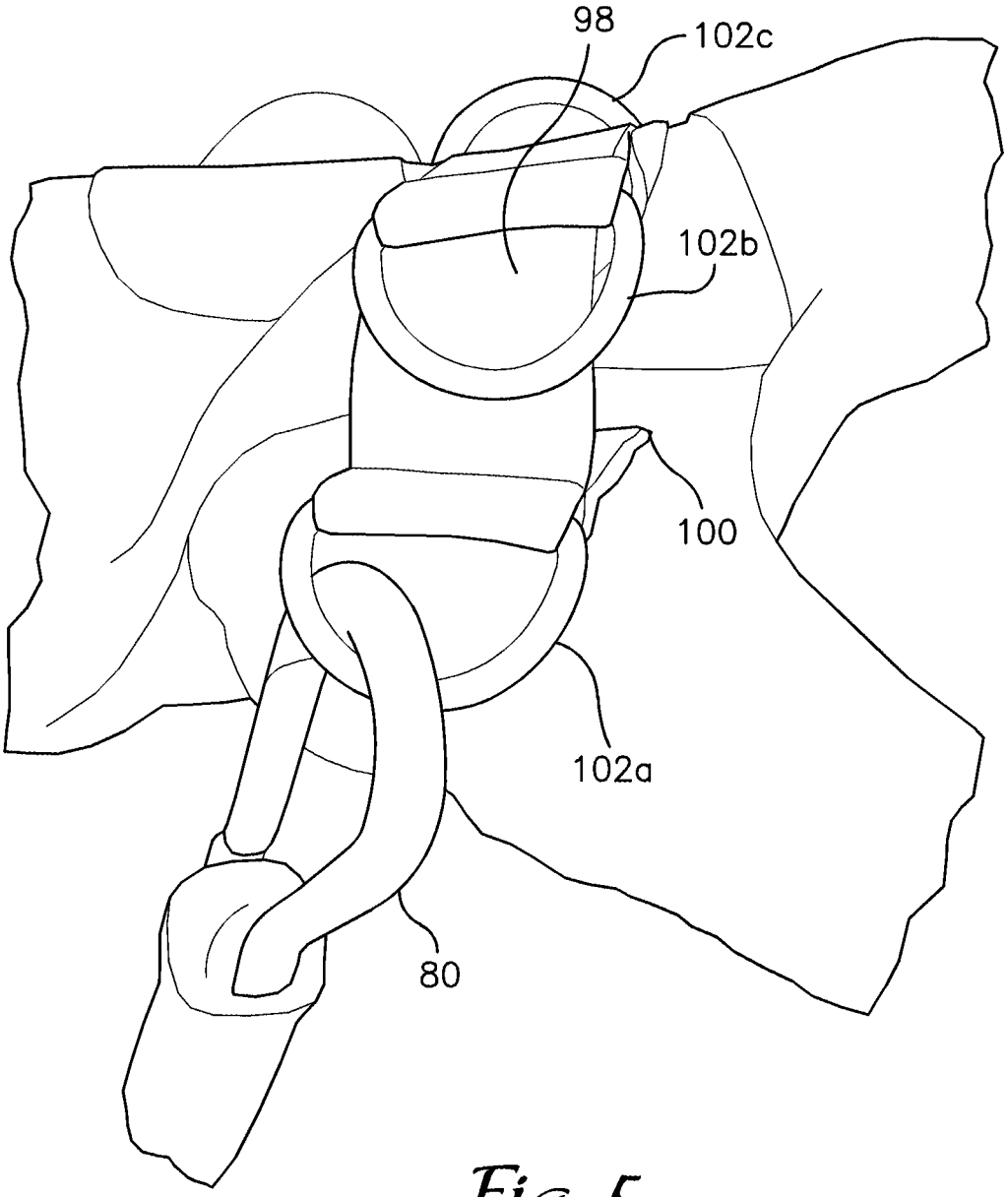
FIG. 5 is an enlarged partial perspective view of the glove portion of the golf swing training device of FIG. 1.
Figure 6:
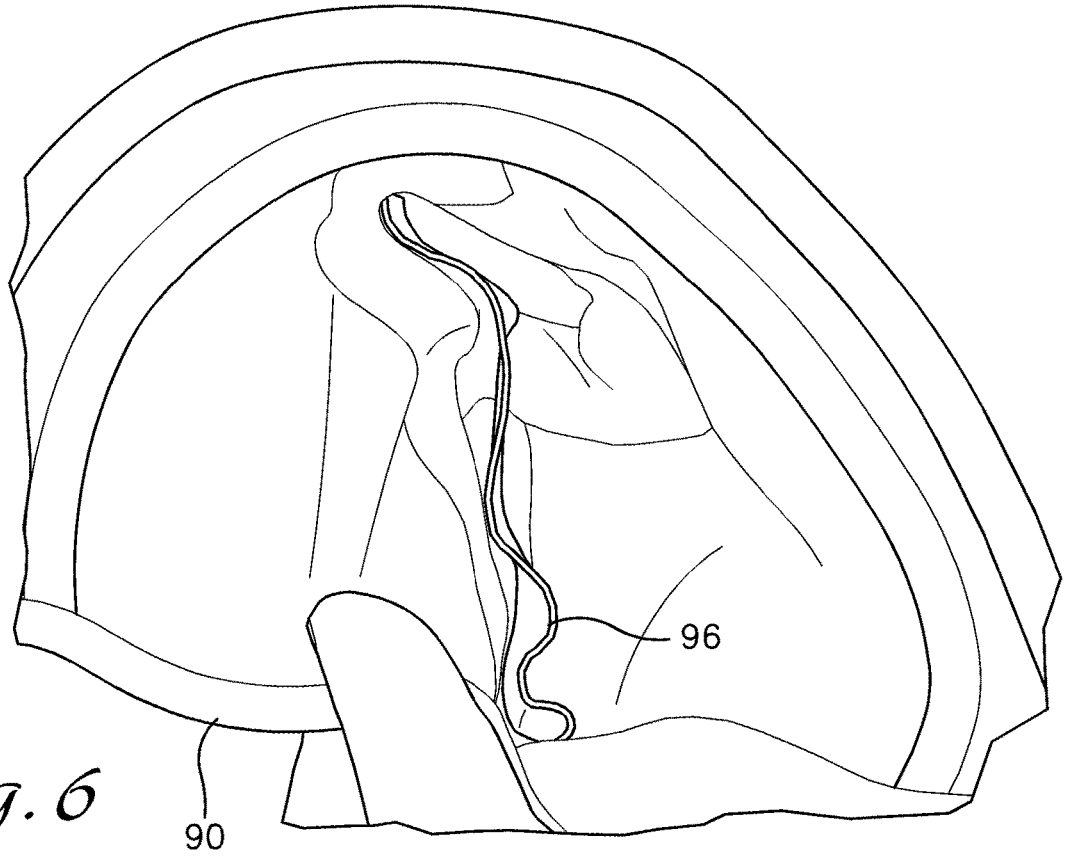
FIG. 6 is an enlarged partial perspective view of the interior of the glove portion of the golf swing training device of FIG. 1.
Figure 7:
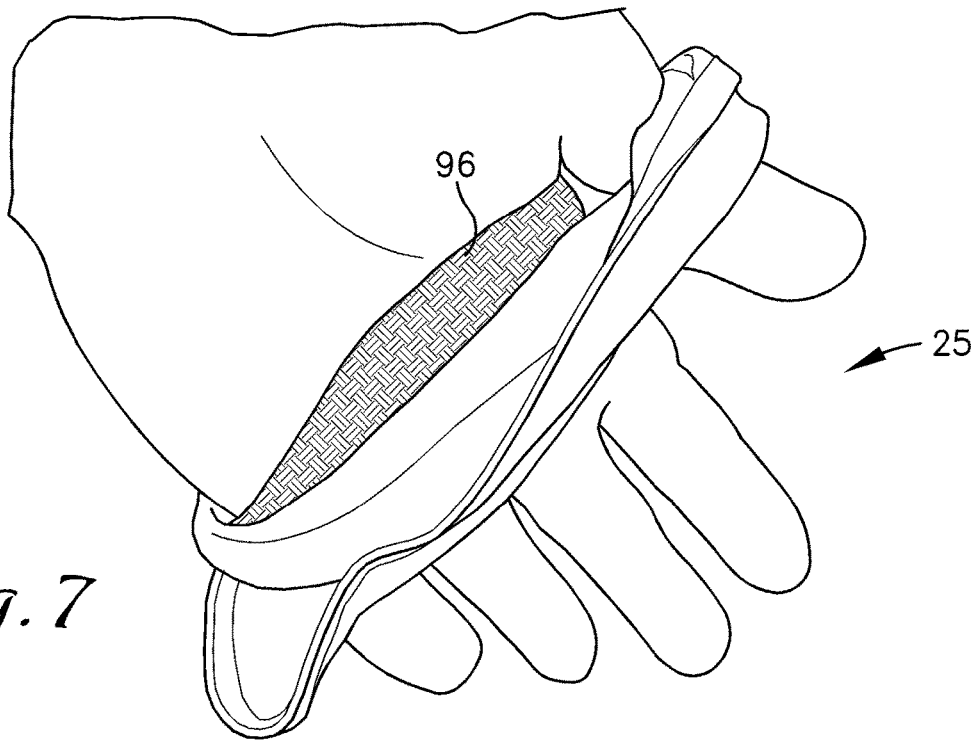
FIG. 7 is an enlarged partial perspective view of the interior of the glove portion of the golf swing training device of FIG. 1 with the glove partially worn on a hand.
Figure 10:
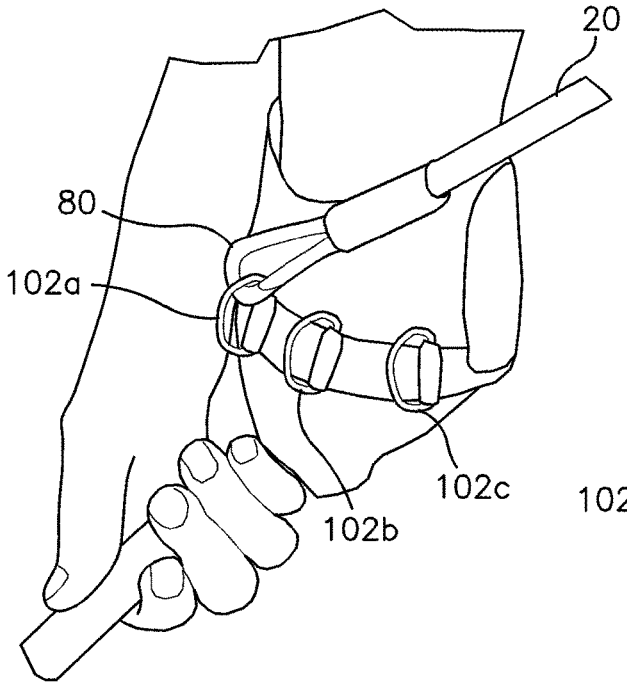
FIG. 10 is an enlarged partial perspective view of the glove portion of the golf swing training device of FIG. 1 worn on a hand with a connecting member in the first position.
Figure 11:
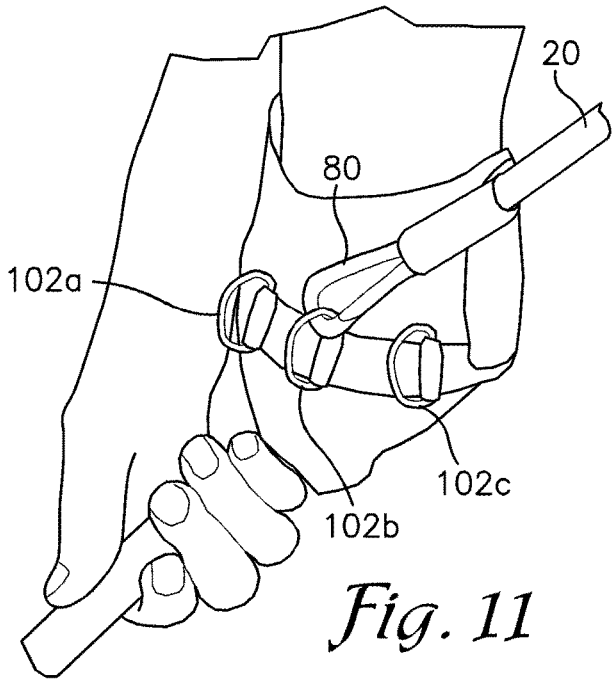
FIG. 11 is an enlarged partial perspective view of the glove portion of the golf swing training device of FIG. 1 worn on a hand with a connecting member in the second position.
Figure 12:
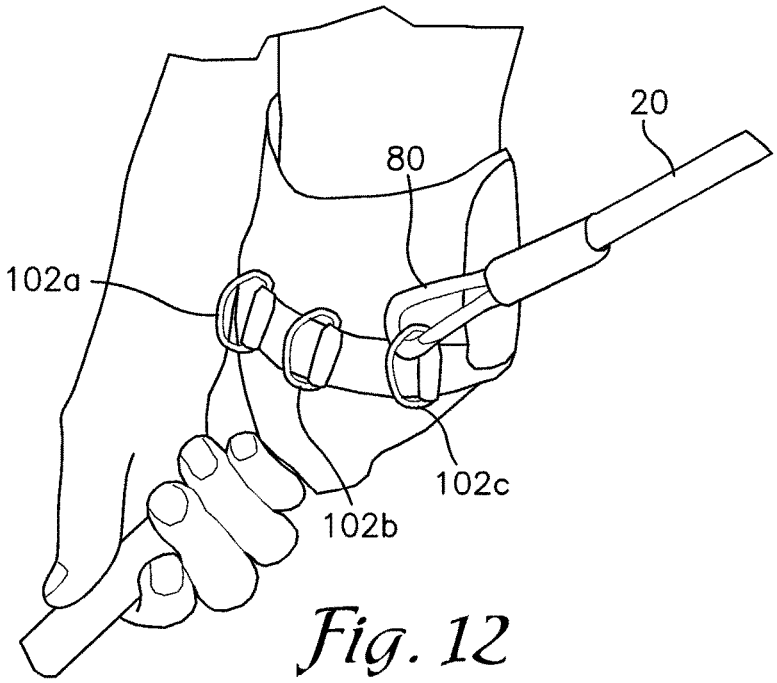
FIG. 12 is an enlarged partial perspective view of the glove portion of the golf swing training device of FIG. 1 worn on a hand with a connecting member in the third position.

As best seen in FIGS. 5-7, glove 25 may include a looped strap or harness 93 that engages with the hand of user 30 when glove 25 is worn. Harness 93 could take many forms including a loop or band, and it can be rigid or flexible. In the exemplary embodiment, harness 93 may be a loop of material that wraps around the user's hand. Harness 93 may include a palm portion 96 that runs across the user's 30 palm and a back portion 98 that runs across the back of the user's 30 hand. When golf swing training device 10 is used, the device tends to exert a pulling force on user's 30 leading hand. Much of this pulling force is transferred to the user 30 through the harness 93. Harness 93 may be integrated into glove 25 such that is creates a stylish aesthetic. For example, as shown in FIG. 4, the back portion 98 of harness 93 may run across the outside of the back part of glove 25 in a location that does not interfere with flap 87 and slit 90. Also, as shown in FIGS. 6 and 7, the palm portion 96 of harness 93 may run inside of glove 25 in a location that allows a user 30 to receive portion 96 in the palm of the hand. Because harness 93 may be partially inside and partially outside of glove 25, the glove may include one or more apertures 100 allowing the harness to enter and/or exit the glove 25. Also, harness 93 may include one or more attachment rings 102 so that connecting member 20 may attach attached to harness 93. While an attachment ring 102 may be located at various places, it is foreseen that a location near the thumb or index finger of glove 25 is suitable for many applications. That location allows the force exerted by golf swing training device 10 to be properly applied to user 30 so as to encourage proper golf swing form. Additional attachment rings may also be used. For example, as best seen in FIGS. 10-12, attachment rings 102*a*, 102*b* and 102*c* may be included, with each ring positioned about the user's hand such that training device 10 provides different alignment benefits. When connecting member 20 is attached to ring 102*a* proximate the thumb or index finger, the device 10 may help the user 30 reduce or eliminate the chance of the golf ball slicing when hit. When connecting member 20 is attached to ring 102*c* proximate the little finger, the device 10 helps the user 30 reduce or eliminate the chance of the golf ball hooking when hit. When connecting member 20 is attached to ring 102*b* proximate the middle back of the hand, the device 10 tends to not alter the user's 30 hand alignment much, if at all, and primarily just helps with strength training.

Figure 8:
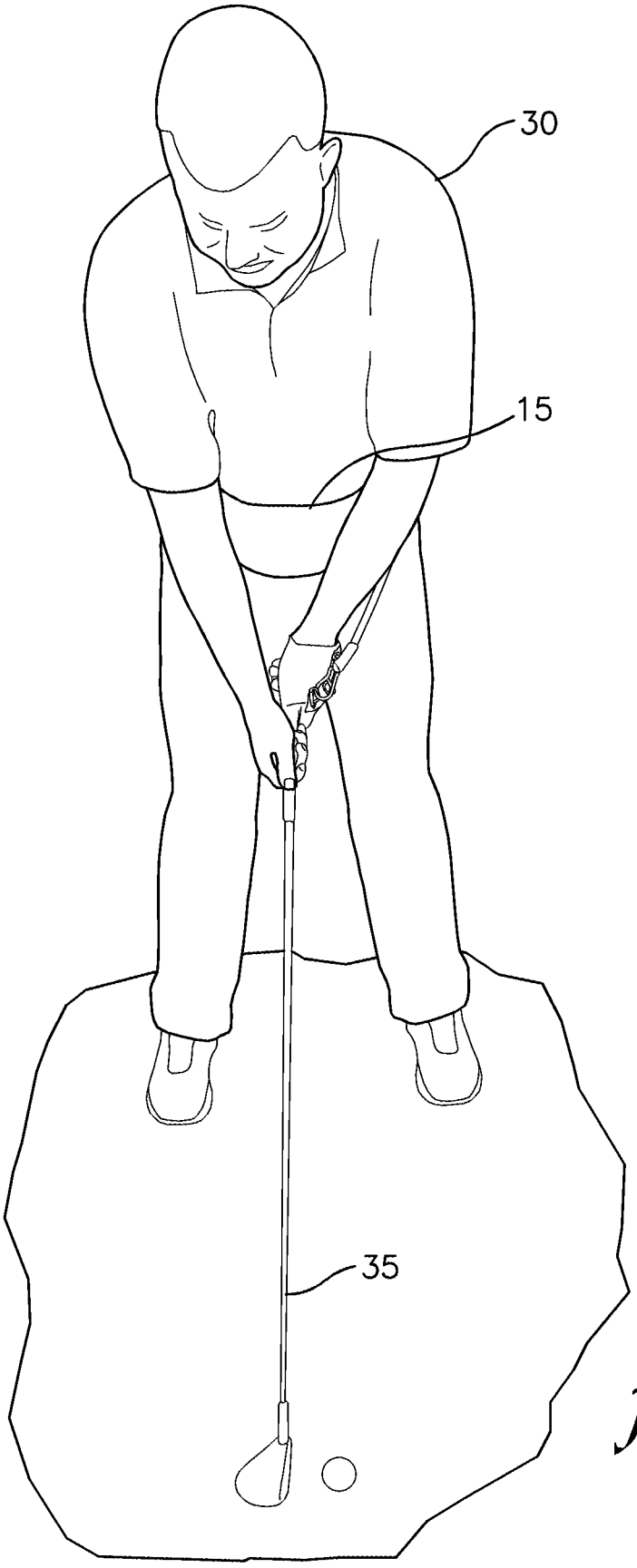
FIG. 8 is a front perspective view of the golf swing training device of FIG. 1 being worn by a user.
Figure 9:
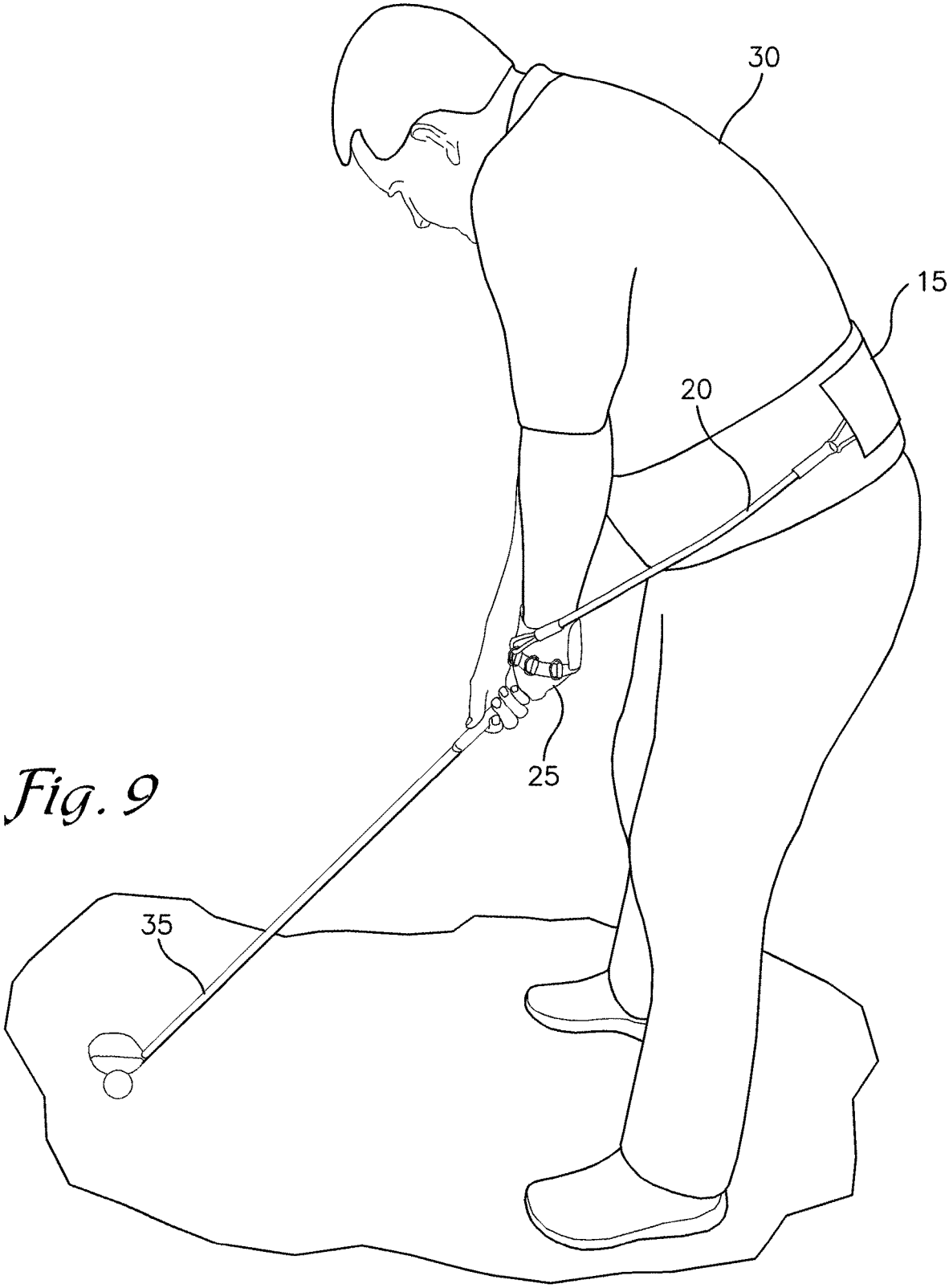
FIG. 9 is a side perspective view of the golf swing training device of FIG. 8.

To use the present invention, a user 30 wears the golf swing training device 10 while swinging a golf club 35, which may be during practice swings and/or while actually hitting a ball. First, a user 30 may assemble the device by securing connecting member 20 to belt 15 and glove 25 (or harness 93). More specifically, the clip 80 at first end 76 of connecting member 20 may be secured to an adjustment ring 61 on belt 15, and clip 80 on second end 77 may be secured to an attachment ring 102 on glove 25. Next, the user may don the golf swing training device 10 by fastening belt 15 around their midsection, typically at or just above their waist. To fasten belt 15, user 30 may pull the belt snug and overlay the first end 50 over the second end 51 to engage hook and loop sections 55 and 57. The belt 15 is snug enough that it does not move or slip when the user 30 is swinging a club but not so tight as to cause discomfort or impair breathing. Next, user 30 may put glove 25 (with the integrated harness 93) on the hand that will be leading during their golf swing. To put on glove 25, flap 87 may be unfastened and the glove 25 may be placed on the hand, making sure that palm portion 96 of harness 93 is in the palm of the hand. Flap 87 can be refastened such that glove 25 is snug but comfortable on the user's 30 hand. When glove 25 is worn properly, connecting member 20 is routed over the back of glove 25 and over user's 30 wrist on its way to belt 15 as shown in FIGS. 8 and 9.

Once the belt 15 and glove 25 are donned, user 30 may check to ensure that connecting member 20 is the proper length. To do this, user 30 may address the golf ball while holding golf club 35. In this pre-swing position with the club head directly behind the ball, there is preferably no slack in connecting member 20. However, connecting member 20 should also not be so taut that it is difficult or uncomfortable to maintain the pre-swing position. In other words, connecting member 20 is preferably barely stretched when user 30 is addressing the golf ball. If the connecting member 20 is either slack or over stretched when user 30 is addressing the ball, the golf swing training device 10 may be removed and the connecting member 20 length adjusted by moving first end 76 to a different adjustment ring 61. Once the connecting member 20 has been adjusted to the proper length, the belt 15 and glove 25 may be donned as previously described.

Figure 13:
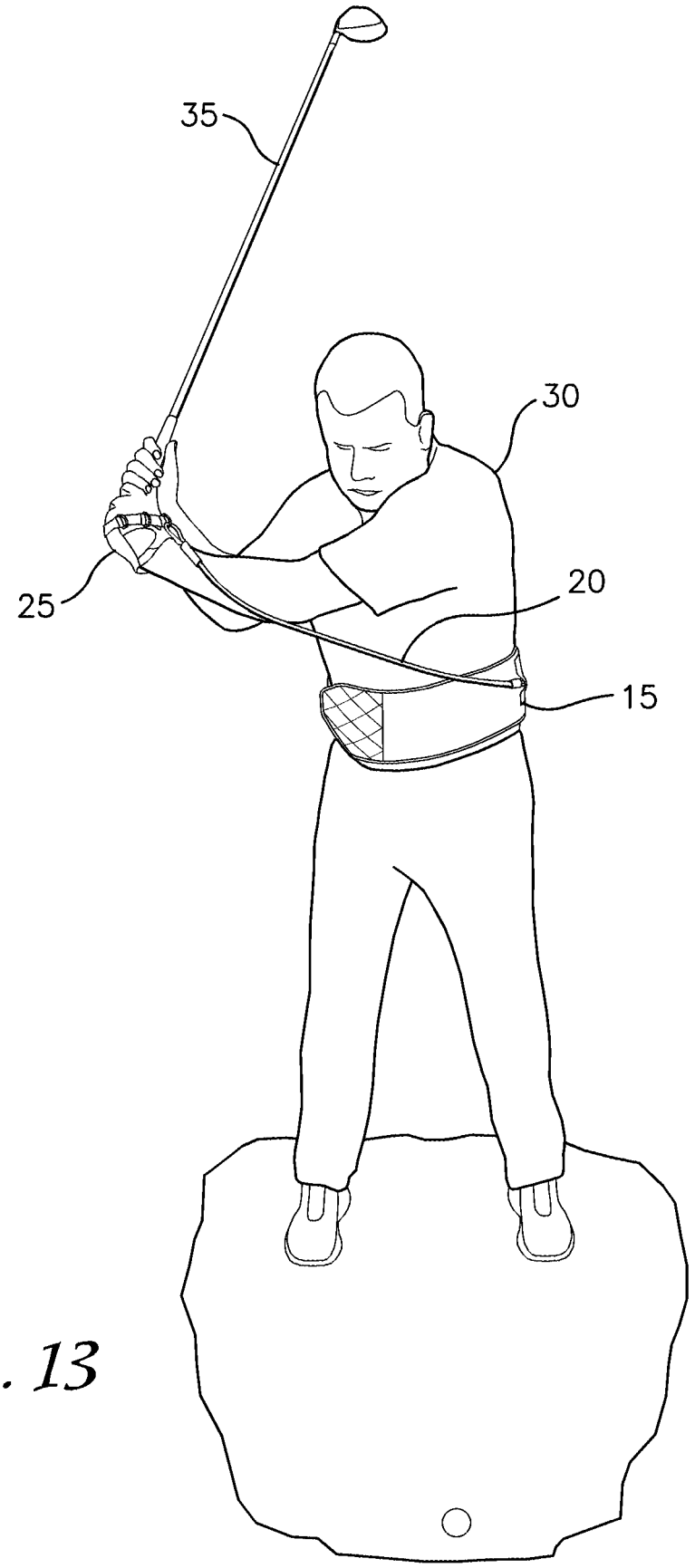
FIG. 13 is a front perspective view of the golf swing training device of FIG. 8 being worn during a golf backswing.
Figure 14:
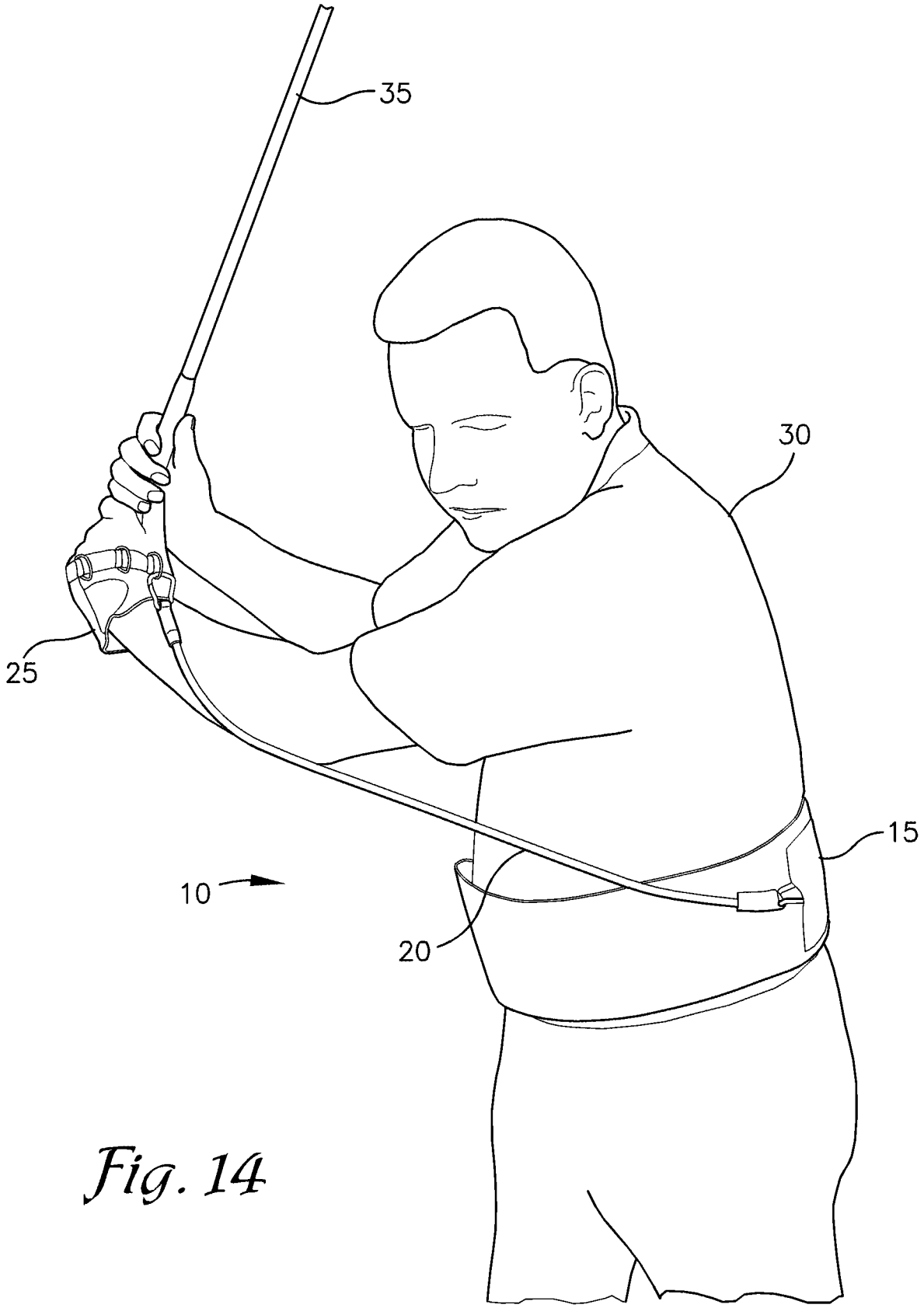
FIG. 14 is a front right perspective view of the golf swing training device of FIG. 8 being worn during a golf backswing.
Figure 15:
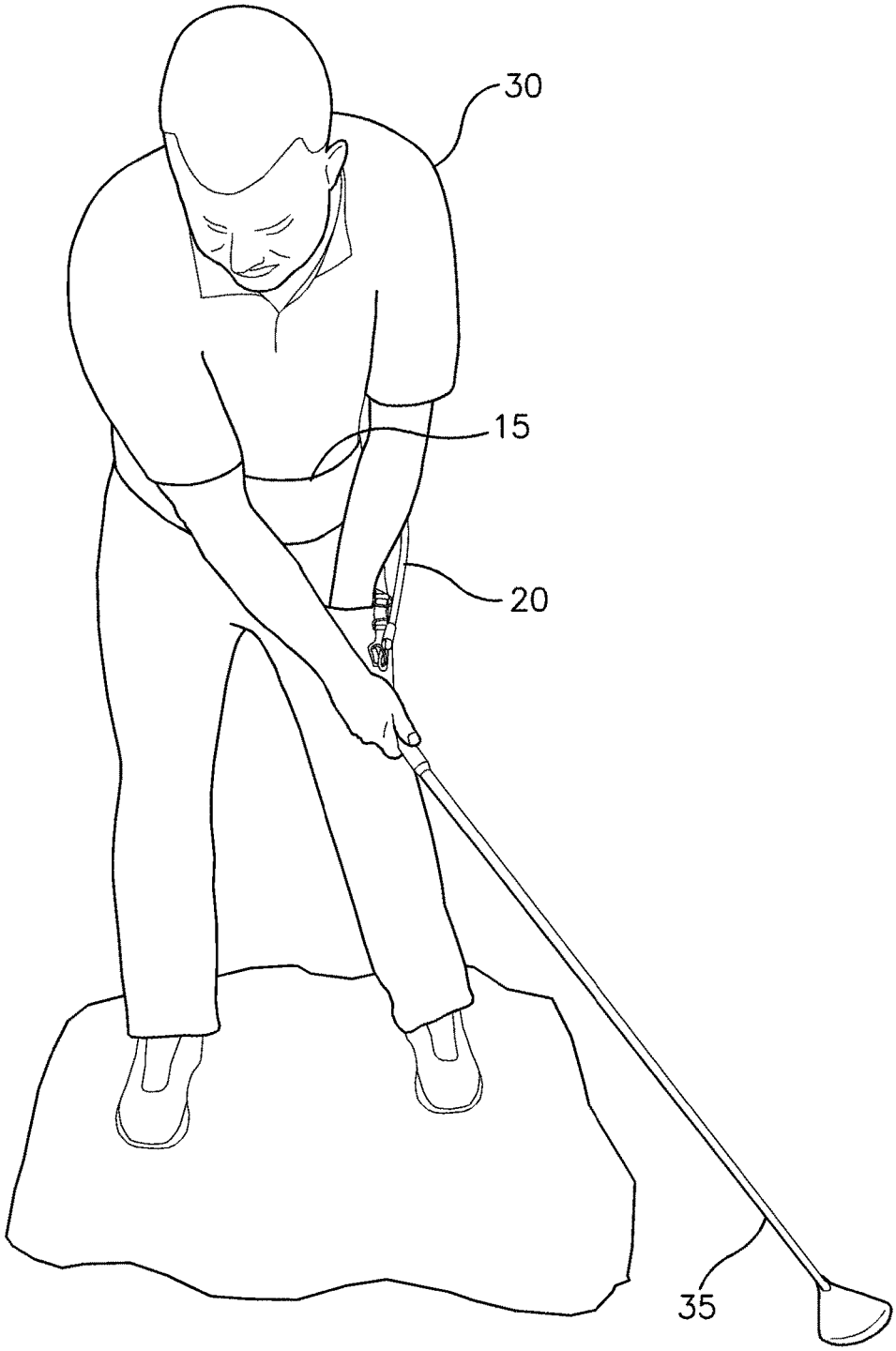

The golf swing training device 10 uses tension in connecting member 20 to apply force to user's 30 hand to help with alignment of the hands (and consequently the club head) during the swing. As shown in FIGS. 13 and 14, when user 30 brings golf club 35 back during the swing, connecting member 20 stretches and applies force to user's 30 hands. The force tends to grow as the back swing progresses, which helps keep the hands appropriately close to the user's body. As show in FIG. 15, during the forward swing, connecting member 20 pulls the leading hand (by pulling on harness 93 which is wrapped around the hand) thereby encouraging the hand to stay close to the body. Connecting member 20 is routed over the back of the hand and attached to a ring 102. Depending on which attachment ring (102*a*, 102*b* or 102*c*) is used, the force exerted on the hands is slightly different. For example, when connecting member 20 is attached to ring 102*a*, the thumb-side of the hand tends to be pulled faster than the other side of the hand. This prevents the hand from inadvertently rotating, which in turn keeps the club head from inadvertently rotating to an open-faced orientation. The effect is that the face of the club head hits the ball squarely (as it was aligned before the swing) so that the golf ball travels straight ahead. Similarly, when connecting member 20 is attached to ring 102*c*, the little finger side of the hand tends to be pulled faster than the other side of the hand. This prevents the hand and club head from inadvertently rotating to a closed-faced orientation, which again helps the face of the club head to hit the ball squarely. When connecting member 20 is attached to ring 102*b* proximate the middle back of the hand, there is little to no effect on the rotation of the hands and club head. In this situation, training device 10 can be used as a strength training aid. Repeated use of the golf swing training device 10 teaches the user 30 how to minimize unintended rotation of their hands and club, as well as promoting faster club head speed, thereby teaching the user 30 how to hit a straighter and more consistent shot.

The golf swing training device 10 can also be adjusted so that more or less force is applied to user's 30 hands. This allows an advance user 30 to train for different shots such as those that are intentionally not straight. For example, the tension of connecting member 20 may be adjusted to apply more or less force than normal to a user's 30 hands, which can cause the user 30 induce a draw or fade in the shot as desired. By applying more or less force to the hands, the hands may end up rotating more or less than a normal straight shot. As a result, the club head may rotate to create the desired draw or fade ball trajectory. The tension of connecting member 20 may be adjusted by moving first end 76 to a different adjustment ring 61 thereby changing the amount that connecting member 20 stretches during a backswing.

It is to be understood that while certain forms of the present invention have been illustrated and described herein, it is not to be limited to the specific forms or arrangement of parts described and shown.

Having thus described the invention, what is claimed as new and desired to be secured by Letters Patent is as follows:

1. A golf swing training device having components to be worn by a user during a golf swing, said golf swing training device comprising:

a glove having a harness, said glove having a back portion and a palm portion, said harness adapted to wrap around the user's hand such that a first part of said harness is adjacent the palm side of the user's hand and a second part of said harness is adjacent the back side of the user's hand, wherein said first part of said harness is located between the palm side of the user's hand and said palm portion of said glove;

a belt having a plurality of looped connection points; and a connecting member adapted to be connected at a first end to one of said looped connection points and at a second end to said harness.

2. The golf swing training device of claim 1, wherein said first part of said harness is inside of said glove.

3. The golf swing training device of claim 2, wherein said second part of said harness is outside of said glove.

4. The golf swing training device of claim 3, wherein said belt has a first end and a second end and said plurality of looped connection points is located proximate a midpoint between said first end and said second end.

5. The golf swing training device of claim 4, wherein each of said looped connection points comprises a ring.

6. The golf swing training device of claim 5, wherein said connecting member comprises a piece of stretchable tubing.

7. The golf swing training device of claim 6, wherein said belt comprises a hook and loop fastening system.

8. The golf swing training device of claim 7, wherein said belt comprises a cover over said plurality of looped connection points.

9. The golf swing training device of claim 8, wherein said connecting member is connectable to said harness by latching said connecting member to a ring member attached to said harness.

10. A golf swing training device having components to be worn by a user during a golf swing, said golf swing training device comprising:

a glove having a front portion and a back portion, said glove adapted to be worn on a hand of the user during a golf swing, said front portion adapted to be adjacent the palm of the user's hand and said back portion adapted to be adjacent the back of the user's hand;

a harness adapted to wrap around the user's hand, wherein a first part of said harness is located between the palm of the user's hand and said front portion of said glove and a second part of said harness is adjacent said back portion of said glove;

a band of material adapted to be worn around the user's midsection, said band of material having a looped connection point; and a connecting member having a first fastener at a first end and a second fastener at a second end, wherein said first fastener is adapted to be connected to said looped connection point and said second fastener is adapted to be connected to said harness.

11. The golf swing training device of claim 10, wherein said band of material has a first end and a second end and said looped connection point is located proximate a midpoint between said first end and said second end.

12. The golf swing training device of claim 11, wherein each of said looped connection point comprises a ring member.

13. The golf swing training device of claim 12, wherein said connecting member comprises a piece of stretchable tubing.

14. The golf swing training device of claim 13, wherein said band of material comprises a section of hook fasteners proximate said first end and a section of corresponding loop fasteners proximate said second end.

15. The golf swing training device of claim 14, wherein said band of material comprises a cover over said ring member.

16. A golf swing training device having components to be worn by a user during a golf swing, said golf swing training device comprising:

a glove having a front portion and a back portion, said glove adapted to be worn on a hand of the user during a golf swing, said front portion adapted to be adjacent the palm of the user's hand and said back portion adapted to be adjacent the back of the user's hand;

a harness comprising a strip of material adapted to wrap around the user's hand, wherein a first part of said harness is between the palm of the user's hand and said front portion of said glove and a second part of said harness is located on said back portion of said glove such that at least part of said back portion of said glove is located between said second part of said harness and the back of the user's hand, said harness having a plurality of rings attached thereto;

a belt having a plurality of annular connection points; and a connecting member having a first fastener at a first end and a second fastener at a second end, wherein said first fastener is adapted to be connected to one of said annular connection points and said second fastener is adapted to be connected to one of said rings.

17. The golf swing training device of claim 16, wherein said belt has a first end and a second end and said plurality of annular connection points is located proximate a midpoint between said first end and said second end.

18. The golf swing training device of claim 17, wherein said connecting member comprises a piece of stretchable tubing.

19. The golf swing training device of claim 18, wherein said belt comprises a section of hook fasteners proximate said first end and a section of corresponding loop fasteners proximate said second end.

20. The golf swing training device of claim 19, wherein said belt comprises a texture adapted to minimize slippage of said belt on the user.

* * * * *